United States Patent [19]

Juhas

[11] Patent Number: 4,694,624

[45] Date of Patent: Sep. 22, 1987

[54] MODULAR PRE-INSULATED, PRE-FINISHED BUILDING BLOCK

[76] Inventor: William M. Juhas, 2604 Ninth St., Cuyahoga Falls, Ohio 44221

[21] Appl. No.: 820,141

[22] Filed: Jan. 21, 1986

[51] Int. Cl.[4] ..... E04C 3/10

[52] U.S. Cl. ..... 52/228; 52/309.11; 52/590; 52/809; 52/270; 52/285; 52/404

[58] Field of Search ..... 52/227, 228, 309.11, 52/590, 809, 810, 105, 270, 284, 285, 286, 309.9, 266, 269, 425, 426, 592, 404

[56] References Cited

U.S. PATENT DOCUMENTS

| | | | |
|---|---|---|---|
| 1,972,475 | 9/1934 | Davison | 52/285 |
| 2,054,694 | 9/1936 | Eldredge | 52/809 X |
| 2,086,571 | 7/1937 | Novambére | 52/809 X |
| 2,116,020 | 5/1938 | Gauvin | 52/809 X |
| 2,474,654 | 6/1949 | Carlson | 52/105 X |
| 2,684,589 | 7/1954 | Perreton | 52/228 X |
| 2,803,856 | 8/1957 | Kofahl et al. | 52/227 |
| 3,112,578 | 12/1963 | Rosenfeld | 52/228 X |
| 3,236,014 | 2/1966 | Edgar | 52/270 |
| 3,357,146 | 12/1967 | Gartrell | 52/309.11 X |
| 3,462,897 | 8/1969 | Weinrott | 52/309.11 X |
| 3,477,184 | 11/1969 | Johnson et al. | 52/105 |
| 3,665,662 | 5/1972 | Timbrook et al. | 52/270 X |
| 3,736,715 | 6/1973 | Krumwiede | 52/309.11 |
| 4,091,590 | 5/1978 | Miura | 52/592 X |
| 4,125,972 | 11/1978 | Pate | 52/284 X |
| 4,294,051 | 10/1981 | Hughes, Jr. | 52/228 X |
| 4,428,174 | 1/1984 | Grady, II | 52/227 X |
| 4,573,295 | 3/1986 | Wilkinson | 52/105 |

*Primary Examiner*—Carl D. Friedman

*Attorney, Agent, or Firm*—Oldham, Oldham & Webber Co.

[57] ABSTRACT

A modular, pre-insulated and pre-finished structural building block comprised of structural and insulating elements, fastening rods for the attachment of building blocks to one another and to other wall components, and facing elements of selected materials and finishes affixed to the building block. The building block incorporates into its construction common and varying sizes, shapes, and configurations that fasten to one another and to other wall components in the assembly of a wall, and may be unfastened from each other in the disassembly of a wall without damage to the building blocks or wall components. The building block further incorporates into its construction fastening components that attach to fastening couplings in anchor plates, top plates, door and window frames, window sills, and headers. Additionally, the building block incorporates into its construction electrical boxes and wiring conduits attached to and within selected building blocks.

14 Claims, 32 Drawing Figures

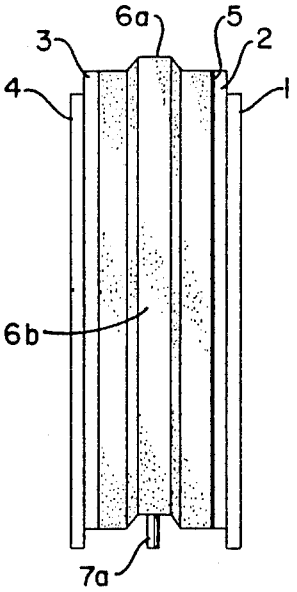
FIG.-4
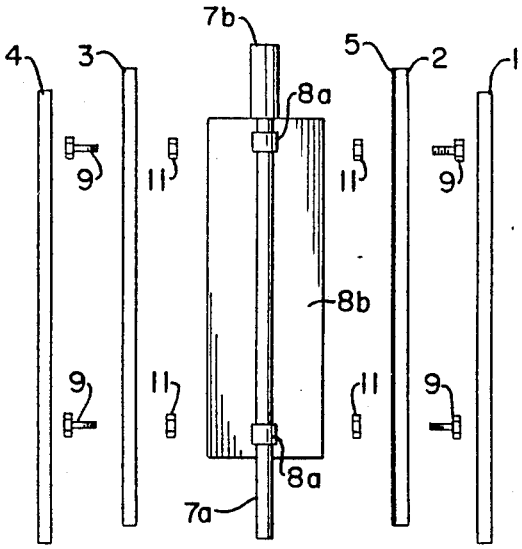
FIG.-5
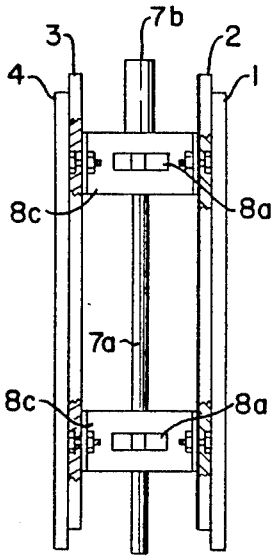
FIG.-6
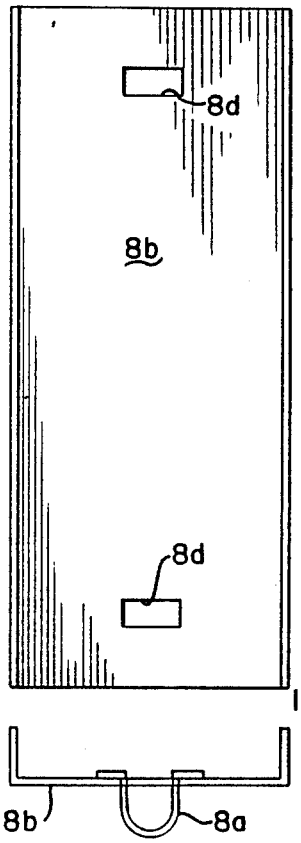
FIG.-11
FIG.-10
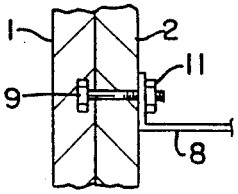
FIG.-12
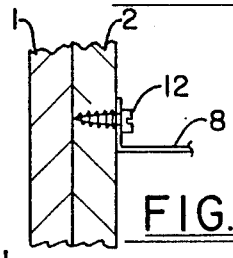
FIG.-13
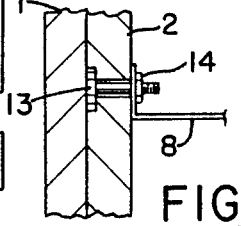
FIG.-14

FIG.-15
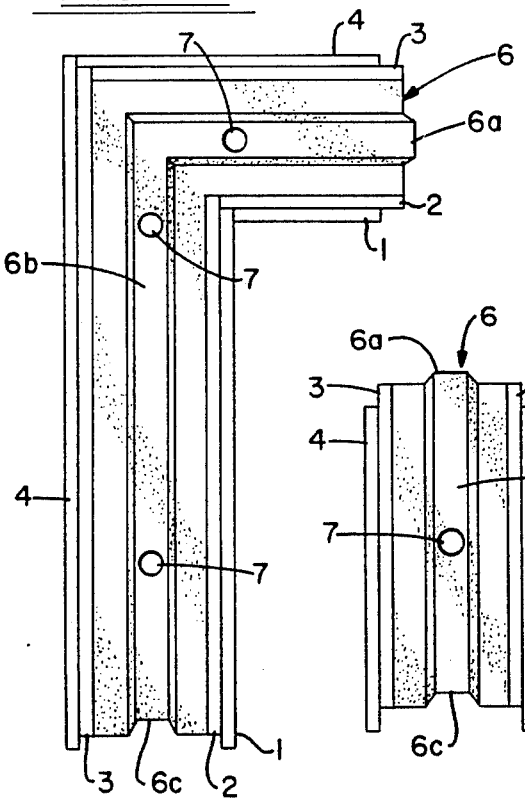
FIG.-18
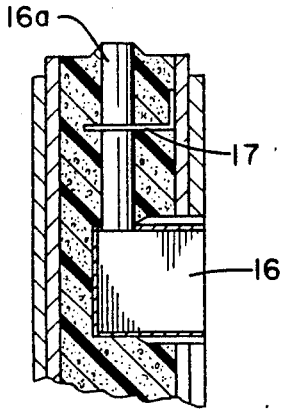
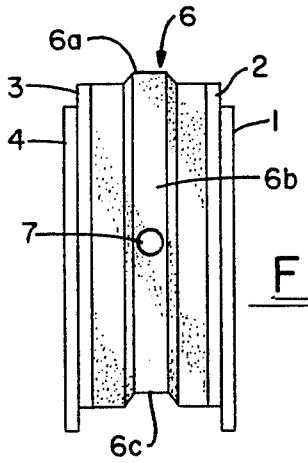
FIG.-16
FIG.-21
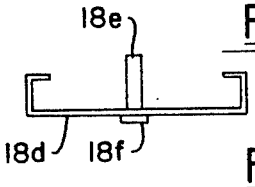
FIG.-22
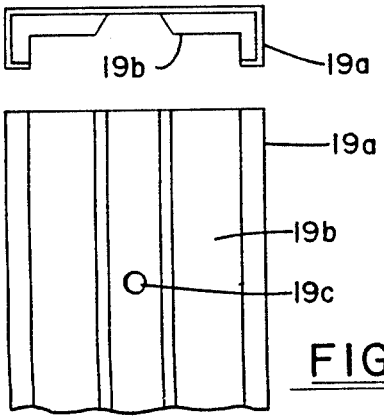
FIG.-23
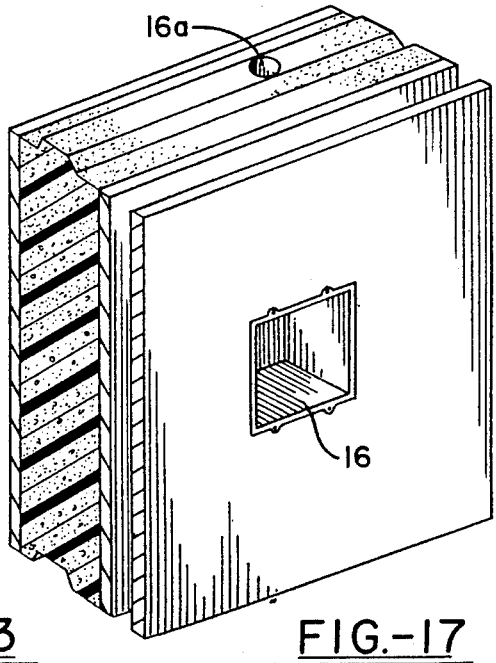
FIG.-17

MODULAR PRE-INSULATED, PRE-FINISHED BUILDING BLOCK

BACKGROUND OF THE INVENTION

1. Field of the Invention

During the past several years, competition for building contracts has dramatically increased. The competition for area construction contracts is no longer limited to area architects, engineers, and contractors, but includes competition from national concerns as well. This competitive environment has forced all those involved in the designing and construction of buildings to seek out alternative building materials that reduce on site construction time, minimize labor costs, improve the quality of construction, and lower building energy costs. Keeping pace with an ever changing industry that demands improved methods and materials to reduce labor costs, reduce on site construction time, and reduce building energy costs, this invention relates to an improved highly insulated building material of modular design that can be quickly assembled into a wall by unskilled labor using only small hand tools.

2. Description of the Prior Art

The prior art with respect to pre-insulated modular panels consists mainly of large panels manufactured by sandwiching rigid foam insulation between sheets of metal or sheets of wood. Sandwich panels of this type do not allow for a selection of facing media and do not meet the standards of many city building codes. Normally, sandwich panels require heavy equipment to set into place and time consuming attachment methods to secure to a pre-erected substructure of steel or wood.

The prior art with respect to concrete tilt wall construction consists of field poured or factory poured concrete panels requiring heavy equipment and special supports and tools to set panels in place. Concrete tilt wall panels are restrictive with respect to appearance, are poor insulators and generally require labor and additional materials from other crafts to complete.

Prior art with respect to other forms of wall construction require workman skilled in their individual trade. Walls constructed and finished by masons, carpenters, insulators, dry wall hangers, dry wall finishers, painters and paper hangers take a great deal of time and labor to complete. Prior art construction methods often find corners out of square and straight walls out of alignment which can take away from the walls structurally, in thermal efficiency and in appearance. Additionally, the thermal efficiency of a wall is further decreased due to uninsulated voids found in and around the frames of windows and doors as well as voids formed by the settling of batt type insulation.

It becomes apparent that improvements can be made in wall construction with respect to time, material, quality, and labor requirements.

A SUMMARY OF THE INVENTION

The invention is a modular pre-insulated and pre-finished structural building block with selective facing media, a means of fastening blocks together and a means of fastening other wall components to the blocks that overcome most disadvantages of prior art. The invention will provide a structural building block of varying sizes, shapes, and configurations that is comprised of two parallel structural elements, two facing elements, an insulating element, a vapor barrier, structural element retainers, fastening rod conduits, and fastening rods. Objects of the invention are to provide a structural building block that is highly insulated; to provide a structural building block that allows for the pre-selection of facing media and finishes (facing media chosen from: masonary, clay, marble, stone, metal, wood, plastic, stucco, plaster, gypsum board, gypsum board covered with paper or vinyl or cloth, or any media suitable for a wall surface); to provide a structural building block that allows for the mixing or matching of facing media without the need for additional support or fasteners; to provide a structural building block available in right angle or corner configurations; to provide a structural building block that can be handled manually be one or two people and without the use of heavy equipment; to provide a structural building block that can be secured in place by using only a small hand tool; to provide a structural building block that can be assembled with other blocks and wall components into a wall by unskilled workers; to provide structural building blocks that can be assembled into a wall and then disassembled from the wall without damage to the building blocks or wall components; to provide a structural building block with selective facing media of masonary, or stone, or clay, or marble, or any other media that normally requires a mortar or cement for securing in a wall that dosen't require mortar or cement for securing into a wall; to provide a structural building block that has contoured top, bottom, and sides that fit the contour of abutting blocks; to provide a structural building block that has contoured top, bottom, and sides that fit the contour of abutting wall components, to provide a structural building block that is easily attached to wall components such as windows and doors with a small hand tool; to provide a structural building block with electrical boxes and other utility boxes pre-mounted into the block where required; and to provide a structural building block with holes bored into the interior insulation of the block where required for the field installation of electrical wiring and piping.

This invention will be further understood with additional objects and advantages becoming apparent from the following description of the preferred embodiment illustrated on the accompanying drawings. Changes may be made however in the construction details and certain features may be used without others. Modifications within the scope of the claims of this invention are included in the invention.

BRIEF DESCRIPTION OF THE DRAWINGS

FIG. 4 is an elevation of the building block shown in FIG. 1 as viewed from the end.

FIG. 5 is an exploded end view of the building block without the insulation.

FIG. 6 is an end elevational view of the building block, with parts broken away and parts shown in section.

FIG. 10 is an elevation of a structural element retainer.

FIG. 11 is an end view of a structural element retainer and conduit attachment ring.

FIG. 12 is an enlarged section of a structural element retainer attached to a masonary structural/facing element.

FIG. 13 is an enlarged section of a structural element retainer attached to a structural element with a wood screw.

FIG. 14 is an enlarged section of a structural element retainer attached to a structural element with a threaded nut and bolt.

FIG. 15 is a plan view of a building block in a corner configuration.

FIG. 16 is a plan view of a building block seen half as long as the building block shown in FIG. 1.

FIG. 17 is a partial isometric view of a building block as shown in FIG. 1 with an electrical box and electrical wiring conduit mounted into the block.

FIG. 18 is a section of a building block with an electrical box and electrical wiring conduit mounted into the block.

FIG. 21 is an elevation of an anchor plate coupling assembly as viewed from the end.

FIG. 22 is an elevation of a building block top plate as viewed from an end.

FIG. 23 is a partial plan view of a building block top plate as viewed from the bottom.

DESCRIPTION OF THE PREFERRED EMBODIMENT

Figure 1:
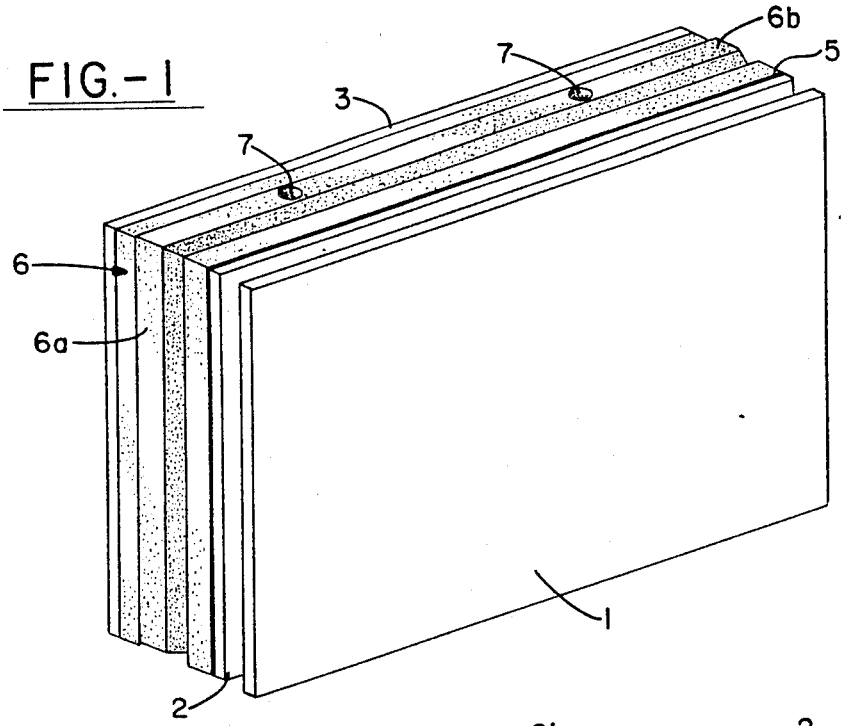
FIG. 1 is an isometric view of a building block.
Figure 2:
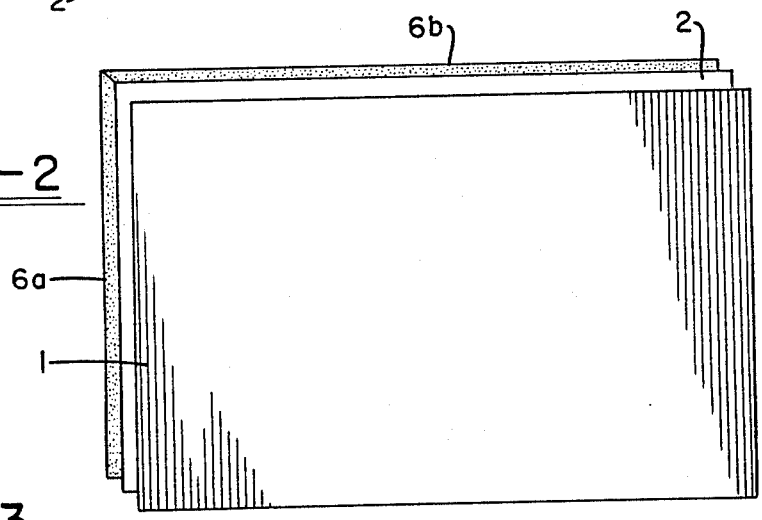
FIG. 2 is an elevation of the building block shown in FIG. 1 as viewed from the side.
Figure 3:
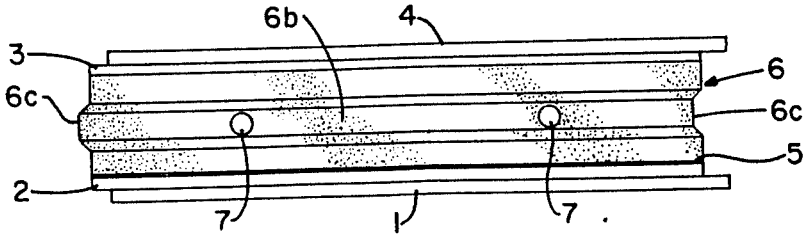
FIG. 3 is an plan view of the building block shown in FIG. 1.
Figure 9:
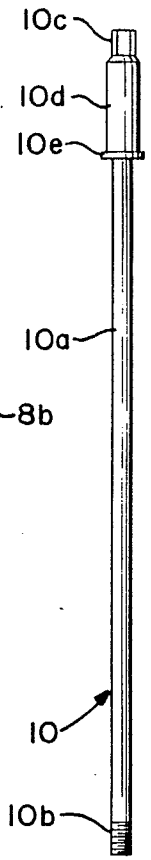
FIG. 9 is an enlarged elevation of a fastening rod.
Figure 8:
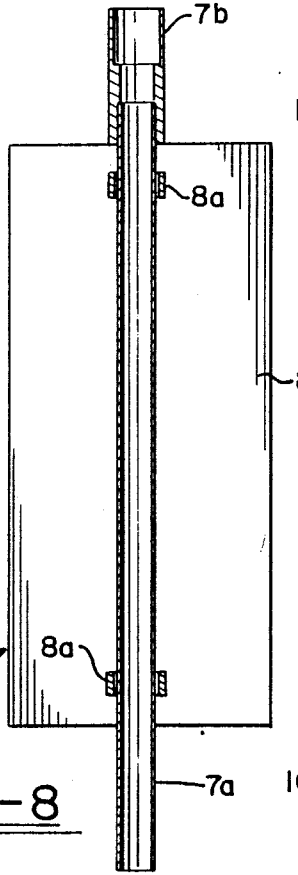
FIG. 8 is an enlarged cross section elevation of a fastening rod conduit and structural element retainer with parts shown in section.

FIGS. 1, 2, 3, and 4 illustrate a modular, pre-insulated pre-finished structural building block comprised of facing elements (1) and (4); structural elements (2) and (3); vapor barrier (5); insulating element (6); and fastening rod conduits (7). Structural elements (2) and (3) as shown in FIGS. 3, 4, 5, and 6 are parallel, normally have the same face area, and are approximately ½ inch thick. As shown in FIGS. 2, 3, and 4, the facing elements are in an offset position in comparison with structural elements (2) and (3). The offset dimension is approximately ¾ inch from the top and from one side. The offset dimension determines the gap spacing between the facing elements of abutting blocks. So as not to limit the scope of this invention, the offset dimension can be any dimension or be eliminated in its entirety. The material composition of structural elements (2) or (3) is plywood, pressed particle board, masonary, plastic, stone, clay, or any other suitable material that can withstand a design compressive load while in a building block configuration. Structural elements (2) and (3) are not necessarily of the same material composition within the same building block. The nominal dimensions of structural elements (2) and (3) are 24 inches long × 16 inches high. The dimensions given in this text are given by way of example only and in no way limit the scope of this invention. Facing elements (1) and (4) are affixed to the structural elements (2) and (3) respectively by staples, and or nails, and or screws, and or glue. Where the material composition of facing element (1) and structural element (2), or facing element (4) and structural element (3) are the same, a one piece structural/facing element produced by moulding or machine cutting may be used in lieu of combining a structural element and a facing element as previously stated. The face areas, thickness of material, or material composition of facing elements (1) or (4) may not be the same. The material composition of facing elements (1) or (4) may be masonary, clay, stone, marble, wood, metal, plywood, particle board, pressed fiber board, gypsum board, gypsum board covered with a cloth, vinyl, or paper covering, stucco, aggregate mixture, or any other suitable material used for interior or exterior wall facings. Vapor barrier (5) as shown in FIGS. 1 and 3 is applied to the interior facing of a structural element when said element is used in a block designated for an exterior wall. The vapor barrier is any suitable material which can be brushed, rolled, or sprayed on and can stop the normal migration of vapor from entering the interior of the block. A thin plastic sheet may be attached to the internal facing of a structural element in lieu of an applied material to stop migration. Insulating element (6) as shown in FIGS. 1, 2, 3, and 4 is rigid foam. The rigid foam adds strength and stability to the building block. The strength of the foam is determined by it's density. In this embodiment a polyurethane foam having a density of two pounds per cubic foot will be used as an example. However, depending on the structural requirements heavier or lighter density polyurethane, or other insulating foam materials may be used. So as not to limit the scope of this invention, this invention is open to all suitable insulating materials, insulating foam densities, or the complete absence of an insulating material in the block. The insulating value of each block is determined by the density of the insulating foam, the thickness of the insulating foam, and the material and thickness of the structural and facing elements. As an example, a block constructed of 4 inch thick two pound per cubic foot polyurethane foam, a 1½ inch thick combination masonary structural/facing element on one side, a ½ inch thick structural element, and a ½ inch thick gypsum board facing element on the other side has an insulating R value of 28. During the manufacturing process, through the use of a removable mold which encompases the total perimeter of both structural elements (2) and (3), a raised surface "key" (6*a*) and (6*b*), and recess surface "keyway" (6*c*) and (6*d*) as shown in FIGS. 1, 2, 3, and 4 is formed as the insulating foam is injected as a liquid into the mold cavity by either pouring or spraying and allowing the foam material to rise and expand to all areas of the mold. The purpose of the "key" and "keyway" is to restrain airflow from passing through the joints of abutting blocks and other wall components when a "key" fills the cavity of an abutting "keyway". A thin bead of caulking may be applied to the edges of the structural elements as added protection from air and rain infiltration. So as not to limit the scope of this invention, the "key" and "keyway" is not limited to a specific size and shape. The "key" and "keyway" may be eliminated in it's entirety and use caulking alone to keep air and rain from passing through the abutting joints. Fastening rod conduits (7) as shown in FIGS. 1, 3, 4, 5, 6, 7, and 8 are used to house fastening rods (10). The conduits (7) are located on the centerline of a block and 6 inches inward from both ends of the block. Where a block is of such length that the distance between the conduits (7) is greater than 12 inches, the conduits (7) are placed on 12 inch centers starting from the conduits (7) located nearest each end. As illustrated in FIG. 8, fastening rod conduit (7) is comprised of a $\frac{3}{4}$ inch outside diameter $\times$ $15\frac{1}{2}$ inch long metal or plastic tube (*7a*), and a 2 inch long metal or plastic coupling (*7b*). Tube (*7a*) is inserted into coupling (*7b*) a depth of 1 inch and is secured in place by glueing or soldering. The inside diameter of the top coupling (*7b*) is of sufficient size to easily accept a $\frac{3}{4}$ inch lower portion of tube (*7a*) of an upper adjoining block. FIG. 4 illustrates the protrusion of fastening rod conduit (7) from the bottom of the block. FIG. 9 illustrates fastening rod (10) which is comprised of a plastic or metal $\frac{3}{8}$ inch diameter $\times$ 16 inch long rod (10*a*); $\frac{3}{8}$ inch diameter hex head threaded coupling (10*c*); $\frac{5}{8}$ inch outside diameter plastic spacer (10*d*); fixed washer (10*f*); and threads (10*b*). So as not to limit the scope of this invention, the invention is not limited to the size and configuration of the fastening rod as shown.

Figure 7:
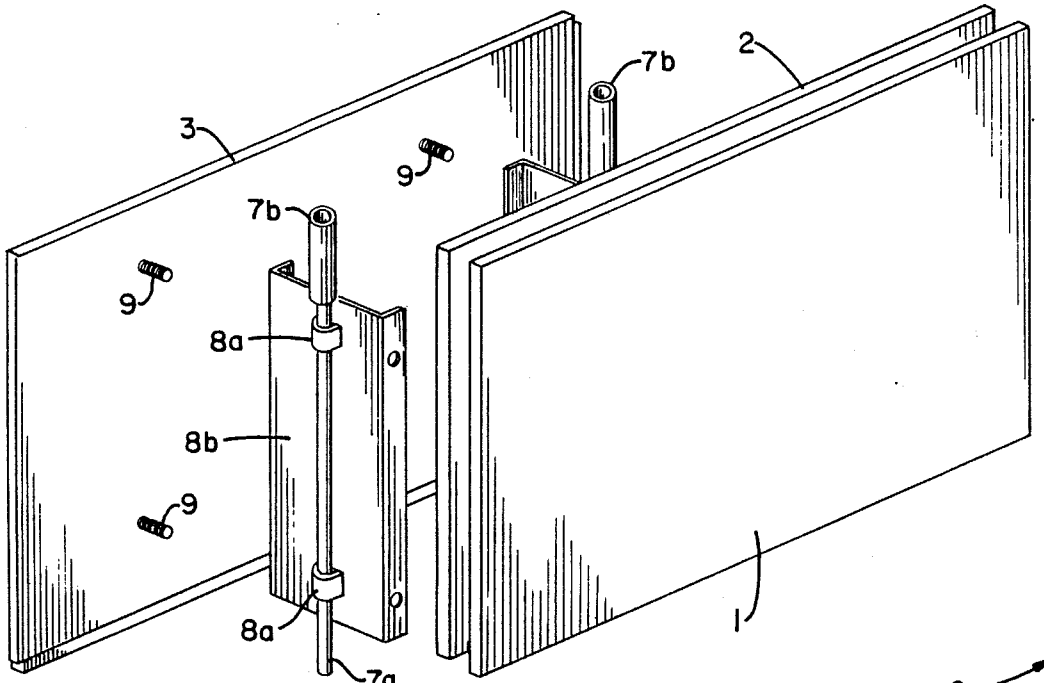
FIG. 7 is a partial exploded isometric view of the building block shown in FIG. 1.

FIG. 8 illustrates a structural element retainer (8) attached to a fastening rod conduit (7). The purpose of the structural element retainer (8) is to position fastening rod conduits (7) within the block, secure structural elements (2) and (3) to each other, and set the width of the block. As shown in FIGS. 10 and 11, structural element retainers (8) consist of a conduit attachment ring (8*a*) and body (8*b*). The body (8*b*) is plastic or metal with two $1\frac{1}{2}$ inch long $\times$ $\frac{1}{2}$ inch wide slots (8*d*) for the attachment of two attachment rings (8*a*) and four $\frac{1}{4}$ inch diameter holes drilled into the turned in legs on the body. A slot and two of the holes are on the same centerline. The centerline of the two slots are located 10 inches apart. The width of the body (8*b*) is determined by the width of the block and the legs of the body are 1 inch long. The length of the body (8*b*) as shown in FIGS. 5 and 7 is 12 inches long. So as not to limit the scope of this invention, the length of the structural element retainer body may be only a few inches long and two structural element retainers (8*c*) will be used in lieu of one 12 inch long retainer as shown in FIG. 6. The structural element retainer body will be of sufficient material thickness as required for strength and stability. FIG. 11 illustrates a conduit attachment ring (8*a*) positioned on a structural element retainer body (8*b*). The attachment ring (8*a*) is inserted into the slot (8*d*) of a structural element retainer body (8*b*) and is permanently secured in place when a fastening rod conduit (7) is placed into it. The conduit (7) is secured to the attachment ring (8*a*) by glueing or soldering. The bottom end of conduit (7) is positioned $3\frac{3}{4}$ inches from the centerline of the lower attachment ring. The structural element retainers (8) are connected to the structural elements by a bolt, screw, or other suitable fastener. FIG. 12 illustrates a structural element retainer (8) attached to a one piece masonary structural/facing element through a $1\frac{1}{2}$ inch long $\times$ $\frac{1}{4}$ inch diameter bolt (9) embedded into the masonary. A $\frac{1}{4}$ inch nut (11) secures the retainer (8) to the structural element. FIG. 13 illustrates a structural element retainer (8) attached to a plywood structural element through a $\frac{1}{4}$ inch diameter $\times$ $\frac{1}{2}$ inch long wood screw (12). FIG. 14 illustrates a structural element retainer (8) attached to a plywood structural element through a 1 inch long $\times$ $\frac{1}{4}$ inch diameter bolt (13) and and nut (14). The bolt (13) is inserted into a 5/16 inch diameter hole drilled into the structural element. The head of the bolt sets in a cavity formed by boring a $\frac{1}{2}$ inch diameter hole a depth of 3/16 inch on the opposite side of the plywood from the retainer element (8). In all the above mentioned structural element attachment methods. the centerline of the attachment bolts or fasteners are located on the structural elements a distance of 3 inches from the top, 3 inches from the bottom, and 5 inches in from each end.

As illustrated in FIG. 15, in corner construction the centerline of the fastening rod conduits (7) are located 6 inches in from each end of the structural elements and on the longer leg of the corner block a third conduit (7) is located on a centerline 18 inches inward from the end of the longer structural element.

FIGS. 17 and 18 illustrate a block with an electrical box (16) assembled into the block. A plastic or metal electrical wiring conduit (16*a*) is secured to the structural element by a brace (17) and is also attached to the electrical box (16). The size of the electrical wiring conduit (16*a*) is of sufficient size to accept electrical wiring. Blocks for mounting above the blocks with electrical boxes are to have full length electrical wiring conduits running the depth of the block and are secured to the structural elements by braces (17) and in such a manner so the centerlines of the conduits (16*a*) are the same when the blocks are secured together in a wall.

Figure 19:
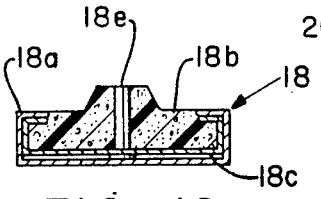
FIG. 19 is a section of a building block anchor plate.
Figure 20:
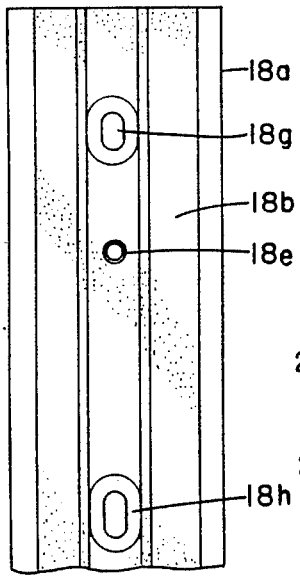
FIG. 20 is a partial plan view of a building block anchor plate.

FIGS. 19 and 20 illustrate an anchor plate (18). The anchor plate is comprised of a metal or plastic base (18*a*); insulating foam (18*b*); and coupling assembly (18*c*). The base material is of sufficient thickness for strength and stability, and is shaped by extruding or bending. For an overall 6 inch thick wall the base is 5 inches wide, 1 inch high and has a $\frac{1}{2}$ inch long leg turned in on each side. The coupling assembly (18*c*) as shown in FIG. 21 is comprised of a carriage (18*d*); coupling (18*e*); and bolt (18*f*). The carriage is metal or plastic and is shaped by extrusion or bending. The carriage in this example is 4 11/16 inches long, $\frac{3}{4}$ inch high with a $\frac{3}{8}$ inch leg turned in on each side. The width of the carriage is 1 inch. A $\frac{3}{8}$ inch diameter threaded coupling (18*e*) is secured to the center of the carriage with a $\frac{3}{8}$ inch diameter bolt (18*f*). The length of the anchor plate is determined by the shape and length of the wall to be anchored to it. Two or more plates may be cut to form right angles or other shapes and are secured to each other by welding or other fastening techniques. One half inch wide $\times$ 1 inch long slots (18*h*) are cut into all the bases on 12 inch centers. Assemblies (18*c*) are prepositioned in the base (18*a*) to correspond with the position of the fastening rod conduits (7) of blocks which will be attached to them. The anchor plates with the carriages in place are set into removable molds and insulating foam (18*b*) is injected into the cavity formed by the mold and the anchor plate. The insulating foam (18*b*) strengthens the anchor plate and permanently secures the carriages in their predetermined positions. In the moulding process a 1 inch wide $\times$ 2 inch long cavity (18*g*) is created at each base slot (18*h*). The anchor plate is anchored to a foundation or floor prior to the wall erection with bolts or anchors and bolts attached to the anchor plate at slots (18*h*). The blocks that set upon the anchor plates are attached to the anchor plates by the block fastening rods (10) which are screwed into carriage couplings (18*e*).

FIGS. 22 and 23 illustrate a top wall plate. The top wall plate consists of a plastic or metal base (19*a*) and insulating foam (19*b*). The base is of sufficient thickness as required for strength and stability and is formed by extrusion or bending. The base in this example is 6 inches wide and $\frac{3}{4}$ inches high with a $\frac{1}{2}$ inch leg turned in on each side. One half inch diameter holes (19*c*) are drilled into the bases on 12 inch centers. Insulating foam (19*b*) is injected into the cavity created by the base and a removable mold. The length of the top plate is determined by the length and configuration of the wall to which it is attached. The top wall plate is attached to the course of blocks it sets upon by $\frac{3}{8}$ inch diameter $\times \frac{1}{2}$ inch long bolts screwed into couplings (10*c*) of fastening rods (10).

Figure 24:
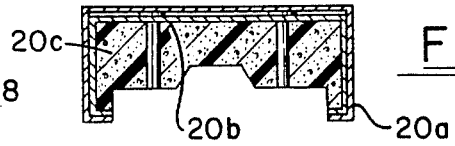
FIG. 24 is a section of a building block door or window jamb.
Figure 25:
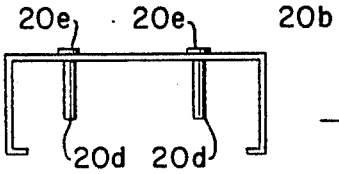
FIG. 25 is an elevation of a door or window jamb coupling assembly.
Figure 26:
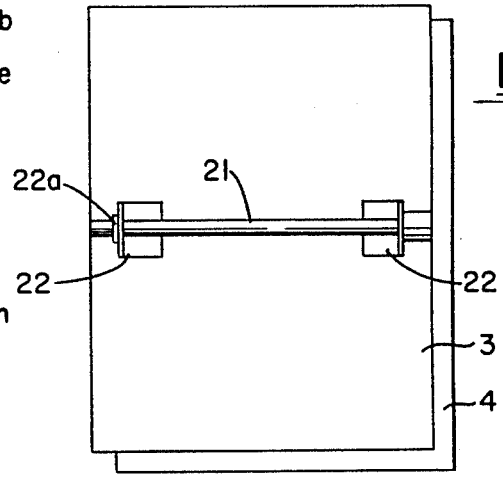
FIG. 26 is an elevation of a structural element with a retainer conduit attached as viewed from the insulation side.
Figure 27:
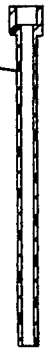
FIG. 27 is a section of a retainer conduit.
Figure 28:
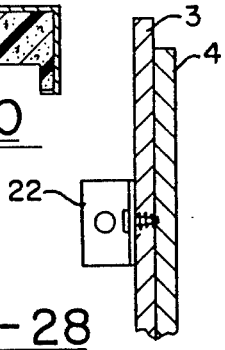
FIG. 28 is a section of a structural/facing element with a retainer conduit attachment angle secured to the structural element.
Figure 32:
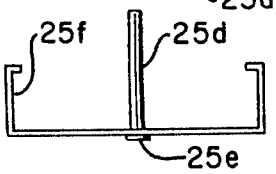
FIG. 32 is an elevation of a door or window header coupling assembly.
Figure 29:
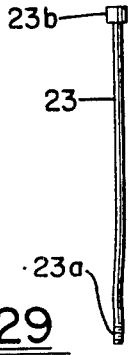
FIG. 29 is an elevation of a jamb fastening rod.

FIG. 24 illustrates a window or door jamb. For simplicity door and window stops are not shown. The jambs consist of a metal or plastic or wood casing (20*a*); coupling assembly (20*b*); and insulating foam (20*c*). The casing is formed by extrusion, bending or fabrication. In this example the casing (20*a*) is 6 inches wide $\times \frac{3}{4}$ inches high with a $\frac{1}{2}$ inch leg turned in on each side. The length of the jambs correspond to the lengths of the doors or windows installed into a wall. The coupling assembly FIG. 25 consists of a carriage (20*b*), two couplings (20*d*), and two attachment bolts (20*e*). The carriage is plastic or metal and is shaped by extrusion or bending. The carriage in this example is $5\frac{3}{8}$ inches long $\times$ 1 inch wide $\times 1\frac{1}{4}$ high with a $\frac{3}{8}$ inch long leg turned in on each side. The two threaded couplings (20*d*) are $\frac{1}{4}$ inch inside diameter $\times$ 1 inch long and are attached to the carriage by $\frac{1}{2}$ inch long bolts (20*e*). The centerline of the $\frac{5}{8}$ inch diameter bolt holes in the carriages are $1\frac{5}{8}$ inches in from each side. Carriages (20*b*) are prepositioned in the jambs (20*a*) to align with retainer conduits (21) as shown in FIG. 26. Insulating foam is injected into the cavity formed by the casing and a removable mold. The insulating foam permanently secures the carriages (20*b*) in their proper positions. Retainer conduits (21) as shown in FIGS. 26 and 27 are attached to $1\frac{1}{2}$ inch $\times 1\frac{1}{2}$ inch $\times$ 1 inch long angles that are attached to the structural elements in a 12 inch long block. The angles are attached to the structural elements in the same manner as described above in attaching other components to the structural elements. As shown in FIG. 28 the angles (22) have a $\frac{1}{2}$ inch diameter hole drilled through it. The hole is centered on the angle leg. The centerline of the holes in the angles (22) are on a line that bisects the structural elements. Retainer conduit (21) is comprised of a 5/16 inch inside diameter $\times 11\frac{3}{4}$ inch long metal or plastic tube (21*a*) and a $\frac{1}{2}$ inch inside diameter $\times \frac{1}{2}$ inch long coupling affixed to the tube by glueing or soldering. As shown in FIG. 26 the retainer conduit (21) is attached to a structural element by placing the retainer tube in the holes of angles (22) that are attached to the structural elements and the retainer coupling is secured in position by a locking ring (22*a*) which is affixed on the retainer conduit. FIG. 29 illustrates a component fastening rod (23). The fastening rod (23) consists of a metal or plastic $\frac{1}{4}$ inch diameter rod with a threaded end (23*a*) and 7/16 inch diameter head (23*b*). The head (23*b*) has an inverted hex or allen head. In this example door and window jambs are attached to 12 inch long building blocks by inserting a component fastening rod (23) into retainer conduit (21) and screwing the rods into couplings (20*d*) located in the jambs.

Figure 30:
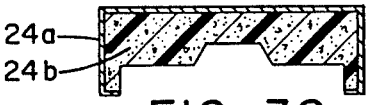
FIG. 30 is a section of a window sill as viewed from an end.

FIG. 30 illustrates a window sill. A window sill consists of a metal, plastic, wood, or other suitable frame (24*a*) formed by extrusion, bending, fabrication, or moulding, and insulating foam (24*b*). The frame in this example is 6 inches wide $\times 1\frac{1}{2}$ inches high with a $\frac{3}{8}$ inch long leg turned in on each side. The sill is attached to the jambs of the window by mechanical means. The sill sets upon the blocks and the jambs are secured to the blocks as described above and in turn secures the sill in place.

Figure 31:
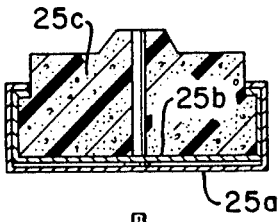
FIG. 31 is a section of a door or window header as viewed from an end.

FIG. 31 illustrates a door or window header. The header consists of a frame (25*a*), coupling assembly (25*b*) and insulating foam (25*c*). The frame (25*a*) is plastic, metal, wood, or any other suitable material and is shaped by extrusion, bending, fabrication, or moulding. The frame in this example is 6 inches wide $\times 1\frac{1}{2}$ inches high with a $\frac{1}{2}$ inch long leg turned in on each side. The coupling assembly (25*b*) consists of a metal or plastic carriage, $\frac{3}{8}$ inch diameter $\times$ 2 inch long coupling, and $\frac{3}{8}$ inch diameter $\times \frac{1}{2}$ inch long bolt. The carriage is $5\frac{3}{4}$ inches wide and $1\frac{1}{4}$ inches high with a $\frac{3}{8}$ inch long leg turned in on each side. The length of the carriage is 1 inch with a 7/16 inch diameter hole drilled in the center. The coupling (25*d*) is attached to the carriage by bolt (25*e*). The carriage (25*f*) is positioned in the frame (25*a*) so that the centerlines of fastening rod conduits (7) of the blocks that are to be attached to the header align with the couplings (25*d*). Insulating foam (25*c*) is injected into the cavity formed by frame (25*a*) and a removable mold. The insulating foam permanently secures the carriages in their positions. The headers are attached to blocks through fastening rods (10).

Blocks are secured to each other by passing fastening rods (10) through conduits (7) and screwing the rods into the fastening rod coupling (10*c*) of an abutting bottom block.

So as not to limit the scope of this invention, this invention is not limited to the sill, jamb, or header construction as specifically stated above. One piece moulded construction with couplings embedded or secured in the proper positions may be attached to the blocks in the same manner as described above.

From the foregoing, it is seen that this invention is one adapted to attain all the objects previously set forth, together with other advantages which are inherent and obvious to the apparatus. It is understood that certain features and sub combinations are of utility, and it is recognized that variations and modifications may readily occur to those skilled in the art.

It is intended that the claims be interpreted to cover such equivalents and sub combinations. This is contemplated by and is within the scope of this invention. As many possible embodiments may be made of the invention without departing from the scope thereof, it is to be understood that all matter herein set forth or shown in the accompanying drawings is to be interpreted in an illustrative and not a limiting sense.

The invention having been described, what is claimed is:

1. A pre-insulated and pre-finished modular building block for a modular building system, said building block comprising:

(a) a pair of spaced parallel structural elements;

(b) a one-piece rigid foam insulating element disposed between said structural elements;

(c) a vapor barrier between one of said structural elements and said insulating element;

(d) structural element retainer means attached to said structural elements for securing said structural elements in predetermined spaced relationship;

(e) at least one tubular conduit for a fastening rod, said conduit being secured to said retainer means and extending through said insulating element extending thereof from one edge to the opposite edge thereof; and (f) a fastening rod extending through said conduit from one edge to the opposite edge of said building block.

2. A building block as in claim 1 including at least one facing element secured to one of said structural elements and forming an exterior surface of said building block.

3. A building block as in claim 1 comprising two facing elements respectively secured to said parallel structural elements and forming the exterior surfaces of said building block.

4. A building block as in claim 3 wherein the edges of said facing elements are offset from the corresponding edges of said structural elements.

5. A building block as in claim 1 wherein said structural elements and said insulating element are rectangular.

6. A building block as in claim 1 in which said insulating element includes means forming a key along at least one edge and a keyway along at least one edge.

7. A building block as in claim 1 wherein said element retainer means is disposed within said block.

8. A building block as in claim 7 wherein said element retainer means comprises a transversely extending plate and flanges extending therefrom, said flanges being in abutting relationship with said structural elements.

9. A building block as claimed in claim 8 including fastener means engaging said flanges and extending into said structural elements.

10. A building block as in claim 1 including means securing said tubular conduit to said element retainer means.

11. A building block as in claim 1 wherein said fastening rod extends vertically.

12. A building block as claimed in claim 1 in which said fastening rod has threads at one end and a threaded coupling at the other end for engaging similar fastening rods associated with adjacent building blocks.

13. A building block as claimed in claim 1 in which said tubular conduit has a coupling at one end for receiving one end of a similar tubular conduit associated with an adjacent building block.

14. A building block as claimed in claim 1, said building block being L-shaped and adapted for corner installation.

* * * * *